US007073767B1

(12) United States Patent
Bennett

(10) Patent No.: US 7,073,767 B1
(45) Date of Patent: Jul. 11, 2006

(54) MOLD FOR SELF SUPPORTING PRIVACY WALL

(76) Inventor: Eldon R. Bennett, P.O. Box 19862, Sarasota, FL (US) 34276

( * ) Notice: Subject to any disclaimer, the term of this patent is extended or adjusted under 35 U.S.C. 154(b) by 62 days.

(21) Appl. No.: 10/463,504

(22) Filed: Jun. 17, 2003

Related U.S. Application Data

(62) Division of application No. 09/709,028, filed on Nov. 8, 2000, now Pat. No. 6,594,963.

(60) Provisional application No. 60/164,844, filed on Nov. 12, 1999.

(51) Int. Cl.
*B28B 7/24* (2006.01)

(52) U.S. Cl. ..... 249/120; 249/129; 249/131

(58) Field of Classification Search ..... 249/109, 249/119, 120, 129, 131, 189, 35
See application file for complete search history.

(56) References Cited

U.S. PATENT DOCUMENTS

| | | | | |
|---|---|---|---|---|
| 1,099,171 | A * | 6/1914 | Evers | 249/50 |
| 1,830,225 | A * | 11/1931 | Dance | 249/123 |
| 2,896,299 | A * | 7/1959 | Hemb | 249/52 |
| 4,881,714 | A * | 11/1989 | Koppenberg | 249/60 |
| 6,395,213 | B1 * | 5/2002 | Staskiewicz et al. | 264/333 |

* cited by examiner

*Primary Examiner*—Donald Heckenberg
(74) *Attorney, Agent, or Firm*—William E. Noonan

(57) ABSTRACT

An outdoor privacy wall that includes at least one self supporting panel mounted on multiple, spaced apart footings disposed in the ground. The panel features a rectangular shape and has opposing faces bounded by parallel upper and lower edges and a pair of parallel side edges connecting the upper and lower edges. At least one of the opposing faces includes a recessed region. A thick peripheral portion surrounds the recessed region and longitudinal reinforcing elements extend longitudinally through the thick peripheral region. A vertically oriented mold assembly is used to manufacture the panels.

6 Claims, 13 Drawing Sheets

MOLD FOR SELF SUPPORTING PRIVACY WALL

RELATED APPLICATION

This application is a division of U.S. Ser. No. 09/709,028 filed Nov. 8, 2000, now issued as U.S. Pat. No. 6,594,963, which, in turn, claims the benefit of U.S. Provisional Application Ser. No. 60/164,844, filed Nov. 12, 1999.

FIELD OF THE INVENTION

This invention relates to a self supporting, pre-cast concrete wall system and, more particularly, to an outdoor privacy wall panel and a process for manufacturing such panels using a vertically arranged mold.

BACKGROUND OF THE INVENTION

Outside privacy walls and fences are commonly erected to surround gated communities, as well as individual residential and commercial buildings. A wide variety of these wall systems are known. Almost all of them exhibit various disadvantages.

Many exterior, stand alone wall systems employ a precast concrete construction. Some of these systems feature prefabricated slabs or panels that are manufactured in horizontally oriented molds. This method of manufacturing is fairly inefficient. When the completed slab is released and removed from the mold, it typically undergoes significant stress. Large amounts of reinforcing material must be employed so that the finished panel is strong enough to be lifted out of the mold without cracking. Typically, far more material is employed in the panel than is required for its eventual use as a privacy wall. Moreover, horizontal molds take up large amounts of floor space. A factory with a limited size is thereby limited in the number of wall panels that can be produced during a pre-determined period in time. Walls featuring conventional concrete panels also require the use of support posts between the adjoining panels. Considerable time, effort, material and expense are needed to install these support posts.

Cast-in-place concrete has also been used extensively for outdoor walls. However, such structures usually require continuous footings, special reinforcing and foundations that have to be excavated well below the surface of the ground. Installation of such walls requires a number of steps, each of which involves a specialized task that must be performed by a registered contractor or other specialized tradesmen. As a result, these walls are oftentimes prohibitively expensive. Masonry walls have similar requirements and are likewise quite costly to construct.

Wood fences are a significantly less expensive alternative. Such structures usually can be installed by the homeowner or an unskilled laborer. Moreover, wood fences often do not require structural certification. However, these structures use wood structural posts that deteriorate relatively rapidly, particularly when exposed to harsh weather and/or soil conditions. Wood is also susceptible to termite infestation and dry rot. As a result, wood fences must be replaced more often than other privacy wall systems.

Recently, stucco coated stryofoam walls have become popular. These walls utilize spaced apart steel posts that support the stryofoam and stucco panels. Such products are fairly lightweight and flexibly configured. On the other hand, constructing the wall is labor intensive and again requires a number of different skilled tradesmen. Ants and other insects can invade and destroy the stryofoam. Stucco tends to crack and deteriorate in response to temperature changes, settlement and dynamic loads. The steel posts, which are normally 16 to 12 gauge, are apt to oxidize under moist conditions. This diminishes the longevity of the wall and requires fairly frequent replacement.

SUMMARY OF THE INVENTION

It is therefore an object of this invention to provide an independently supported outdoor privacy wall system that is both aesthetically attractive and much easier and less expensive to manufacture and install than existing wall systems.

It is a further object of this invention to provide a wall system featuring strong and durable components that effectively resist cracking, deformation and deterioration during manufacture, shipment and after installation.

It is a further object of this invention to provide an outdoor wall system that can be erected quickly, conveniently and inexpensively with minimal labor.

It is a further object of this invention to provide an outdoor wall system that may be manufactured in a highly efficient manner and which does not require an unduly large manufacturing facility.

It is a further object of this invention to provide an outdoor wall system that requires substantially less material than conventional systems and which substantially reduces the costs and weight of the finished wall without sacrificing strength and durability.

It is a further object of this invention to provide an outdoor wall system that effectively resists wind loads in excess of 140 mph.

It is a further object of this invention to provide an outdoor wall system that has corresponding recesses and finishes on both sides of the wall structure so that modular panels may be manufactured, oriented and installed quickly and efficiently.

It is a further object of this invention to provide a method for quickly, conveniently and selectively applying a variety of surface textures, lettering or other display features to the exterior surface of an outdoor wall panel while the panel is being manufactured.

It is a further object of this invention to provide an outdoor wall system that is comparatively lightweight so that it is relatively convenient to manipulate, transport and install.

It is a further object of this invention to provide an outdoor wall system which utilizes materials, factory space and labor in a highly efficient manner.

It is a further object of this invention to provide an outdoor wall system employing wall panels that may be individually repaired or replaced quickly and conveniently.

It is a further object of this invention to provide a method for manufacturing panels for a wall system that substantially reduces the possibility of air pockets being formed within the wall and which thereby improves the structural integrity and appearance of the wall.

It is a further object of this invention to provide an outdoor wall system that does not require a continuous footing, structural supporting posts, a complex foundation or extensive excavation.

It is a further object of this invention to provide an outdoor wall system featuring self supporting wall panels, which eliminate the need to use separate support posts between adjoining panels and which therefore significantly reduce the time, labor, material and expense required to install the wall.

This invention features an outdoor wall system that includes a panel mounted on a pair of footings disposed in the ground. The panel extends upwardly from the ground and the footings in a generally vertical manner. The panel features a substantially rectangular shape and has opposing faces that are bounded by generally parallel upper and lower edges and a pair of generally parallel side edges interconnecting the upper and lower edges. At least one (and preferably each) of the opposing faces includes a recessed central region. A relatively thick peripheral portion of the panel surrounds the recessed central region. The recessed region includes a generally flat interior surface and a beveled or chamfered section that interconnects the interior surface with the relatively thick portion of the panel. The recessed region has a generally rectangular shape that corresponds to the rectangular shape of the panel. This provides the thick peripheral portion of the panel with four thick peripheral segments. A pair of parallel thick segments are formed respectively along the upper and lower edges of the panel. Similarly, a pair of parallel thick side segments are formed along the respective side edges of the panel. An elongate reinforcing bar is formed longitudinally through each of the thick peripheral segments.

In a preferred embodiment, a recessed region is formed in each of the opposing panel faces. The panel thereby includes a relatively thin portion located between the recessed regions in the opposing faces of the panel. An alternative type of reinforcing material such as a microfiber may be formed within the thin portion of the panel. Preferably, the panel is composed of concrete. Each of the opposing faces may feature a similar finish.

A footing is preferably formed at least beneath each thick side segment along the lower edge of the panel. A connecting element may depend from each thick side segment. That connecting element may be inserted into a complementary opening within a respective footing. An appropriate adhesive is used to secure the connecting element within the footing opening. The connecting element may comprise the lower end of the reinforcing bar that extends through the thick side segment or an appropriate steel dowel.

This invention also features a unique vertical mold apparatus in which the panels of this invention are manufactured. The mold apparatus includes a series or battery of mold components that are juxtaposed side-by-side within a frame. Each mold component includes means defining a generally flat, vertically oriented support member. Each support member carries at least one recess-defining component, which component is releasably attached to a respective side of the support member. A support member is formed at each end of the series of mold components within the frame. Each support member at the end of the series carries a single recess-defining component, which is attached to an interiorly facing surface of the support member. Each of the other intermediate support members may carry a pair of releasable recess-defining components. Each such recess-defining component is attached to a respective side of the support member to which it is releasably mounted or permanently attached. A generally vertical void or space is formed between each adjoining pair of mold components. This void or space receives concrete or other material forming the wall panel. Alternatively, members can be cast without the recess defining component.

The frame encloses the series of mold components and holds those components securely together in a juxtaposed condition so that a plurality of generally parallel, vertically oriented voids are formed. The material forming the wall panels is introduced into the voids and allowed to set or harden. Such material is preferably added through an injection port formed into each void proximate the lower end thereof. As a result, concrete or other material forming the wall is pushed upwardly through the void so that air pockets are eliminated. After the panel sets, the frame is released and the completed panels are raised vertically out of the mold. Significantly less stress is exerted on the panels when they are lifted vertically rather then horizontally.

BRIEF DESCRIPTION OF THE DRAWINGS

Other objects, features and advantages will occur from the following description of a preferred embodiment and the accompanying drawings, in which.

Figure 1:
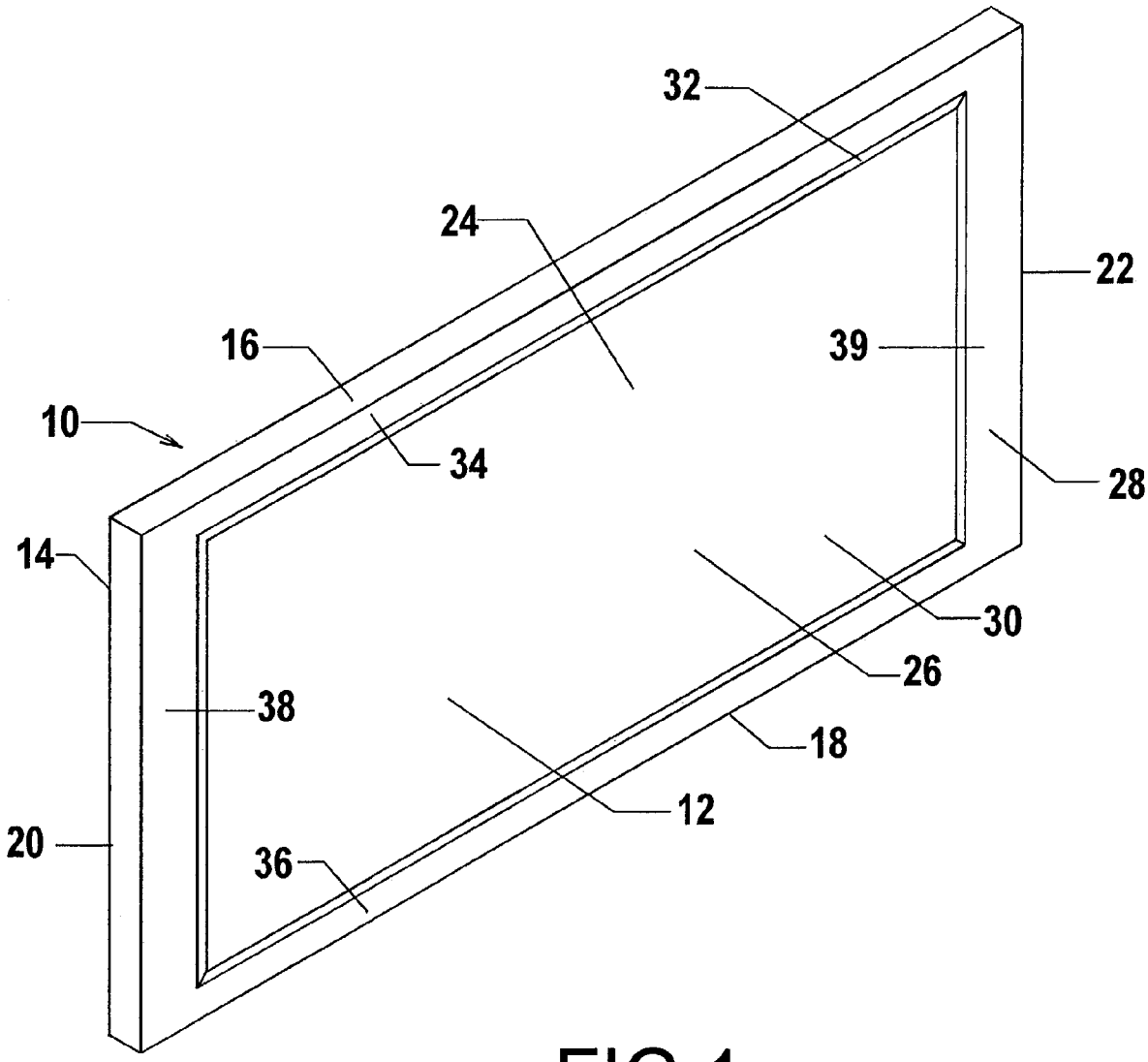
FIG. 1 is a perspective view of the recessed wall panel of this invention.

There is shown in FIG. 1 a prefabricated, self supporting wall panel 10 constructed in accordance with this invention. Panel 10 has a rectangular shape. Typically, the length of the panel is greater than its height although this is not an absolute limitation of the invention. The particular dimensions may be varied, although a typical height is 5', 6' or 8'. The length of the panel is preferably between 10' and 20' although this may be varied as well. It should be noted that the panel of this invention may, in certain cases, comprise shapes other than a perfect rectangle and may feature curved or other specially configured surfaces.

Figure 18:
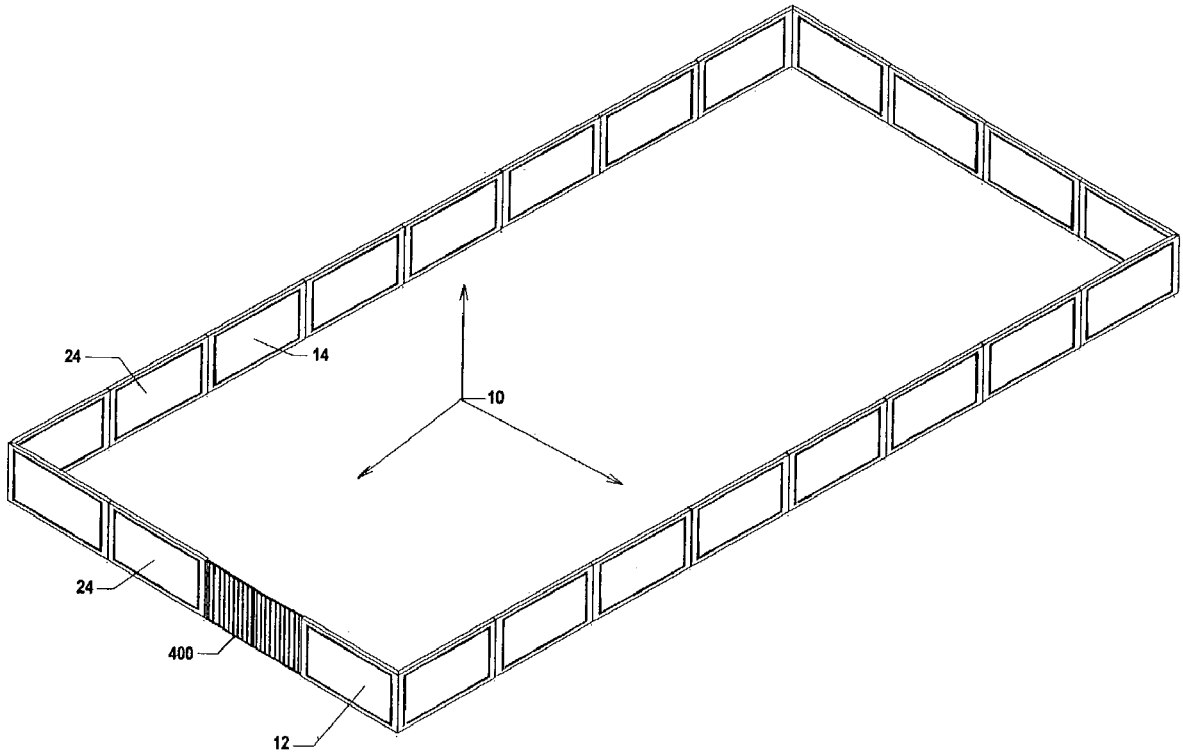
FIG. 18 is a isometric view of a fully assembled privacy wall employing the recessed panels of this invention.

Panel 10 includes a pair of broad opposing faces 12 and 14. The faces have identical or very similar configurations. In FIG. 1, face 12 is fully exposed and face 14 is obscured. (The reverse face 14 is depicted in FIG. 18, which illustrates a fully constructed wall system.) Each of the broad opposing faces of the panel is bounded by parallel upper and lower edges 16 and 18, respectively, as well as parallel side edges 20 and 22. The side edges interconnect the upper and lower edges to define the rectangular shape panel 10. In alternative embodiments the opposing edges may be non-parallel.

Panel 10 is preferably composed of a rugged, moldable material such a pre-cast concrete. Other material such as plastic may be employed. In any event, the material used to form the panel should be durable and exhibit a high strength that is suitable in building and construction applications.

Each of faces 12 and 14 includes a centrally located recessed region 24. The recessed region has a rectangular shape that corresponds to the rectangular exterior shape of panel 10. Because a similar recessed region 24 is formed in each of the faces 12 and 14, the panel includes a relatively thin central portion 26, which is framed or surrounded by a relatively thick peripheral portion 28. The thin central portion may be reinforced by microfiber. Each recessed region 24 is specifically defined by a generally flat interior surface 30 and a rectangular beveled or chamfered portion 32 that surrounds surface 30 and interconnects that surface with thick portion 28. The thick peripheral portion includes a pair of parallel thick segments 34 and 36 formed along the top and bottom edges 16 and 18, respectively, of panel 10. The thick peripheral portion also includes a pair of thick side segments 38 and 39 formed along the side edges 20 and 22, respectively, of the panel. In alternative embodiments, the recessed portion and the peripheral may have alternative shapes and sizes. Likewise, the beveled portion 32 interconnecting the interior surface and the thick periphery of the panel may have various alternative shapes and angles. Normally, the thick periphery or perimeter portion has a thickness of approximately 5" and thin portion 26 has a thickness of about 2". Once again, these dimensions may be varied within the scope of the invention.

As is described in greater detail below, a standard reinforcing element (rebar) extends longitudinally through each of the thick segments 34, 36, 38 and 39 of peripheral portion 28. Panel 10 is particularly distinguished from the prior art because rebar does not extend through thin central portion 26. Instead, the central recessed region may be reinforced with a microfiber type reinforcing material that is mixed with the concrete or other material forming the wall panel when it is cast. Because both rebar and concrete are eliminated from the central recessed portions 24 of panel 10, considerable material, weight and expense are saved.

The recessed wall panels are preferably manufactured using the battery mold assembly 40 shown in FIGS. 2–9. Assembly 40 includes an exterior frame 42 that encloses and holds together a series of juxtaposed mold components 44. Frame 42 includes a support base 46 shown alone in FIG. 5. The support base includes 4 elongate steel tube components 48, 50, 52 and 54 that are welded or otherwise attached together in an end-to-end rectangular configuration. A plurality of elongate steel beams 56, 58, 60 and 62 are arranged side-by-side and extend longitudinally between components 48 and 52. The beams support a plate 63 (see also FIGS. 6, 7 and 9) that defines a floor surface for supporting the mold components.

Figure 2:
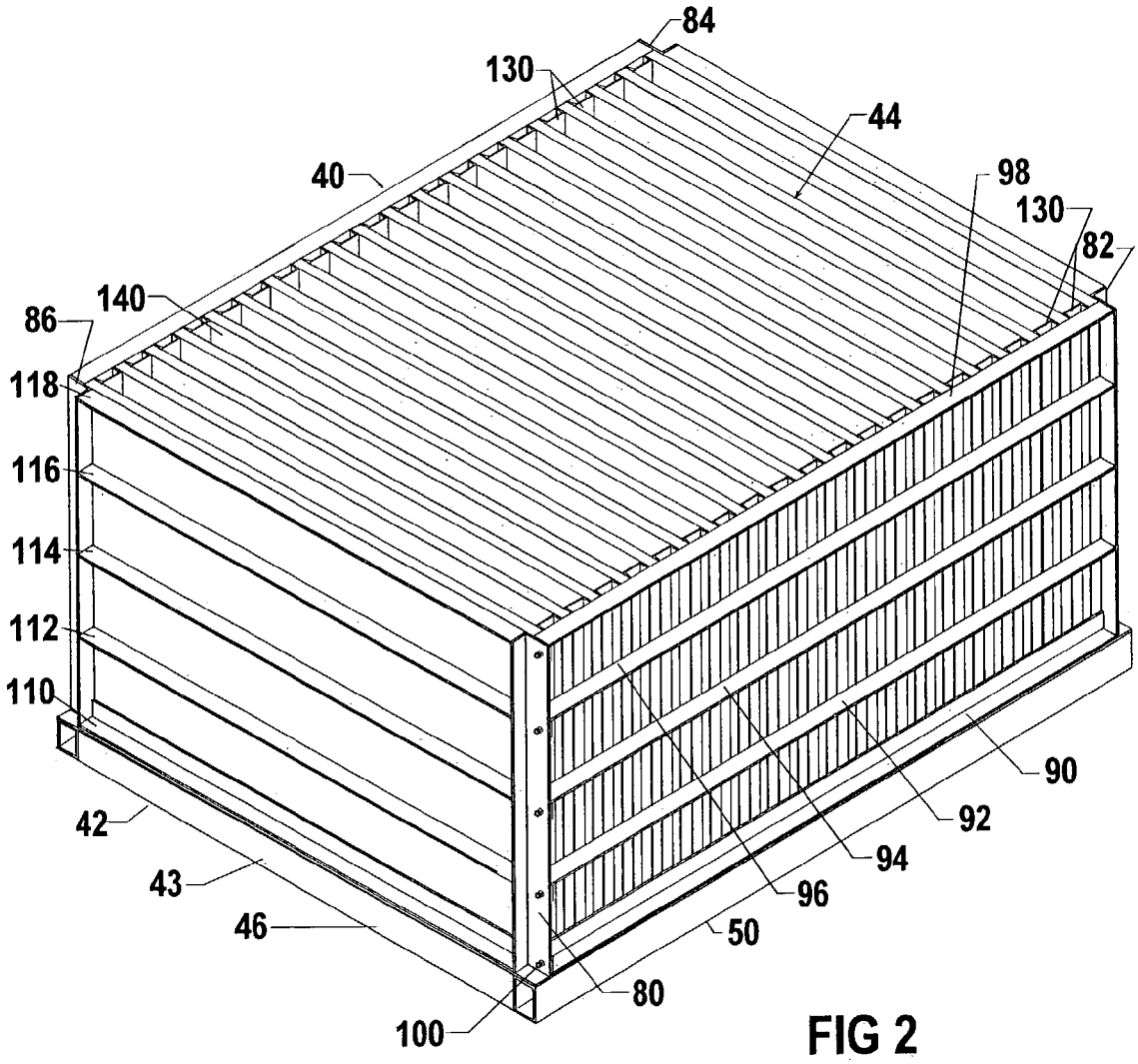
FIG. 2 is perspective view of the panel mold assembly employing a plurality of vertically arranged mold components for manufacturing recessed wall panels according to this invention.

As shown in FIG. 2, four elongate angle pieces 80, 82, 84 and 86 extend vertically upwardly from support base 46. See also FIGS. 3 and 4. The elongate vertical angles of the frame are welded at their lower ends to the support beams 50, 52, 54 and 48, respectively. As shown in FIGS. 2–7, a plurality of elongate, horizontal angle components 90, 92, 94, 96 and 98 extend transversely across one end of assembly 40. Each of the foregoing angles extends between vertical angles 80 and 82 and is suitably attached thereto by bolt assemblies 100 or otherwise. A similar series of horizontal angle components 102, 103, 105, 107 and 109 are similarly mounted between vertical angles 84 and 86 at the opposite end of the mold assembly. (See FIG. 7 and uppermost angle component 102 in FIG. 3.) Otherwise, the construction of the horizontal angle components at the rearward end of the assembly is analogous to the horizontal angle components formed at the forward end of the assembly in FIGS. 2 and 4.

Figure 3:
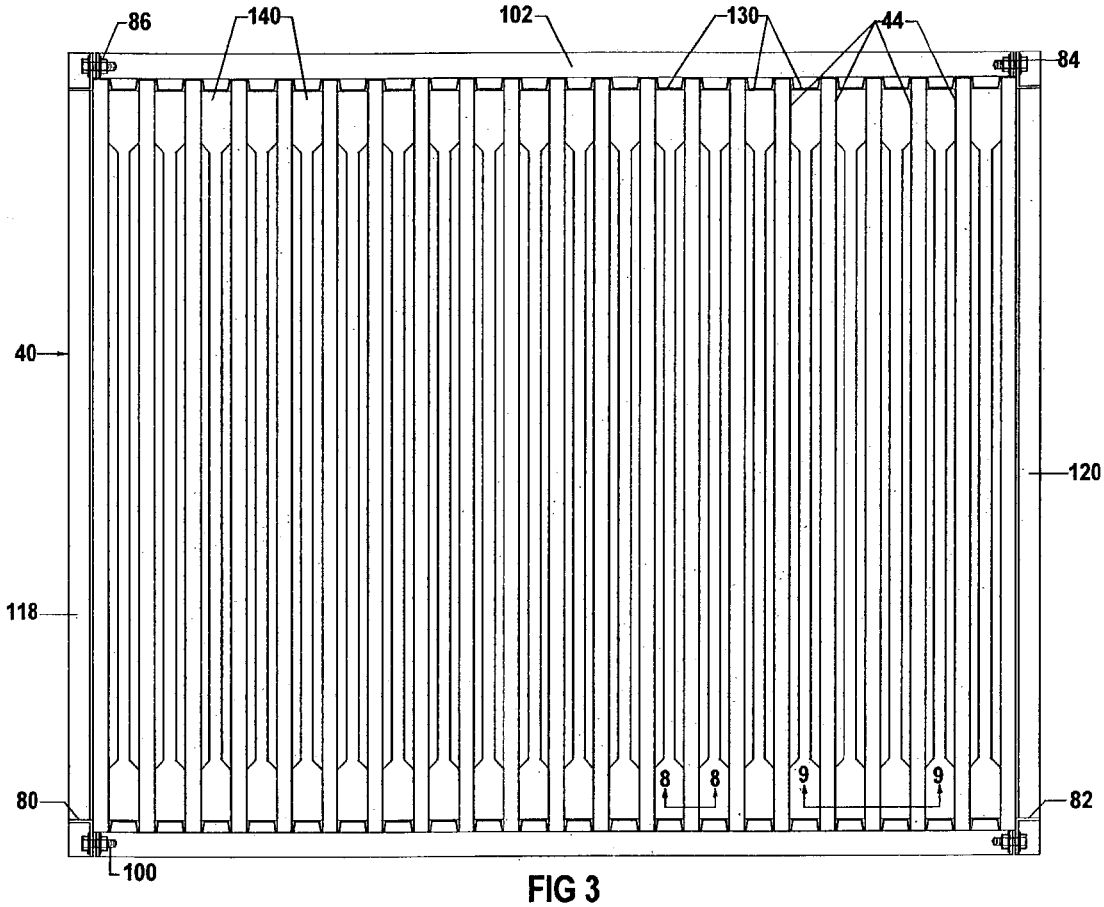
FIG. 3 is a top plan view of the mold assembly.

Frame 42 also includes a pair of opposing parallel side portions that interconnect the end portions described above. In particular, as shown in FIG. 2, frame 42 includes a first side portion comprising a plurality of generally parallel wide flanged beams 110, 112, 114, 116 and 118, which are welded or otherwise interconnected between vertical angles 80 and 86. A similar plurality of beams 120, 121, 123, 125 and 127 (see FIG. 14) are interconnected between vertical angle components 82 and 84 on the opposite side of assembly 40. The uppermost beam 120 is illustrated in FIG. 3. Accordingly, the vertical angle components 80, 82, 84, and 86 are interconnected by two sets of horizontally arranged angle components (e.g. angles 90–98 and angles 102–109) as well as two sets of horizontally arranged side beams (e.g. beams 110–118 and 120–127). This defines a frame which holds a battery of mold components releasably together in the manner described below.

Figure 4:
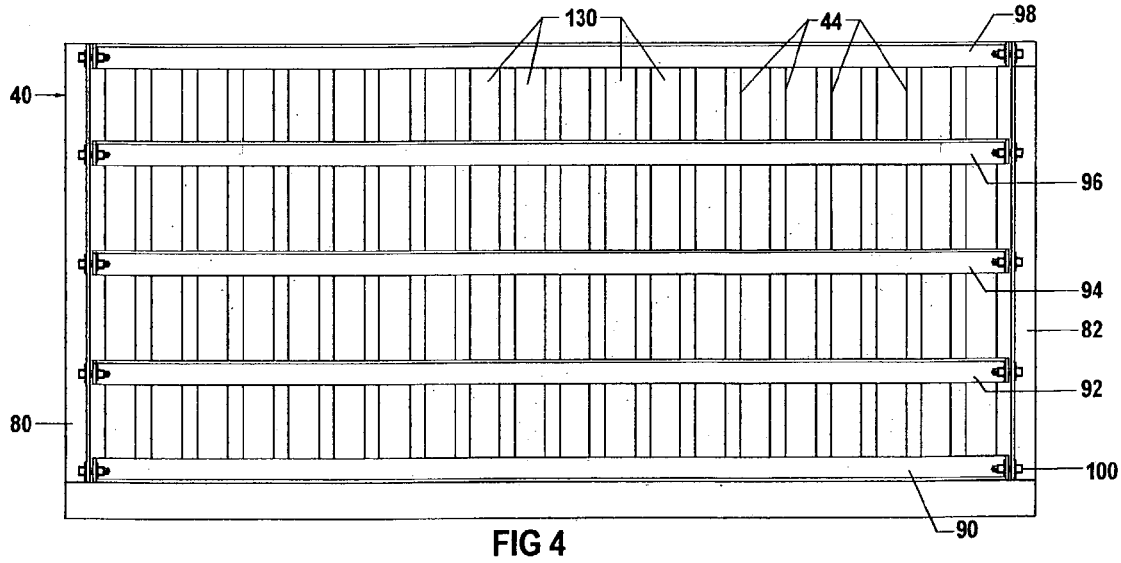
FIG. 4 is a elevational end view of the mold assembly.
Figure 5:
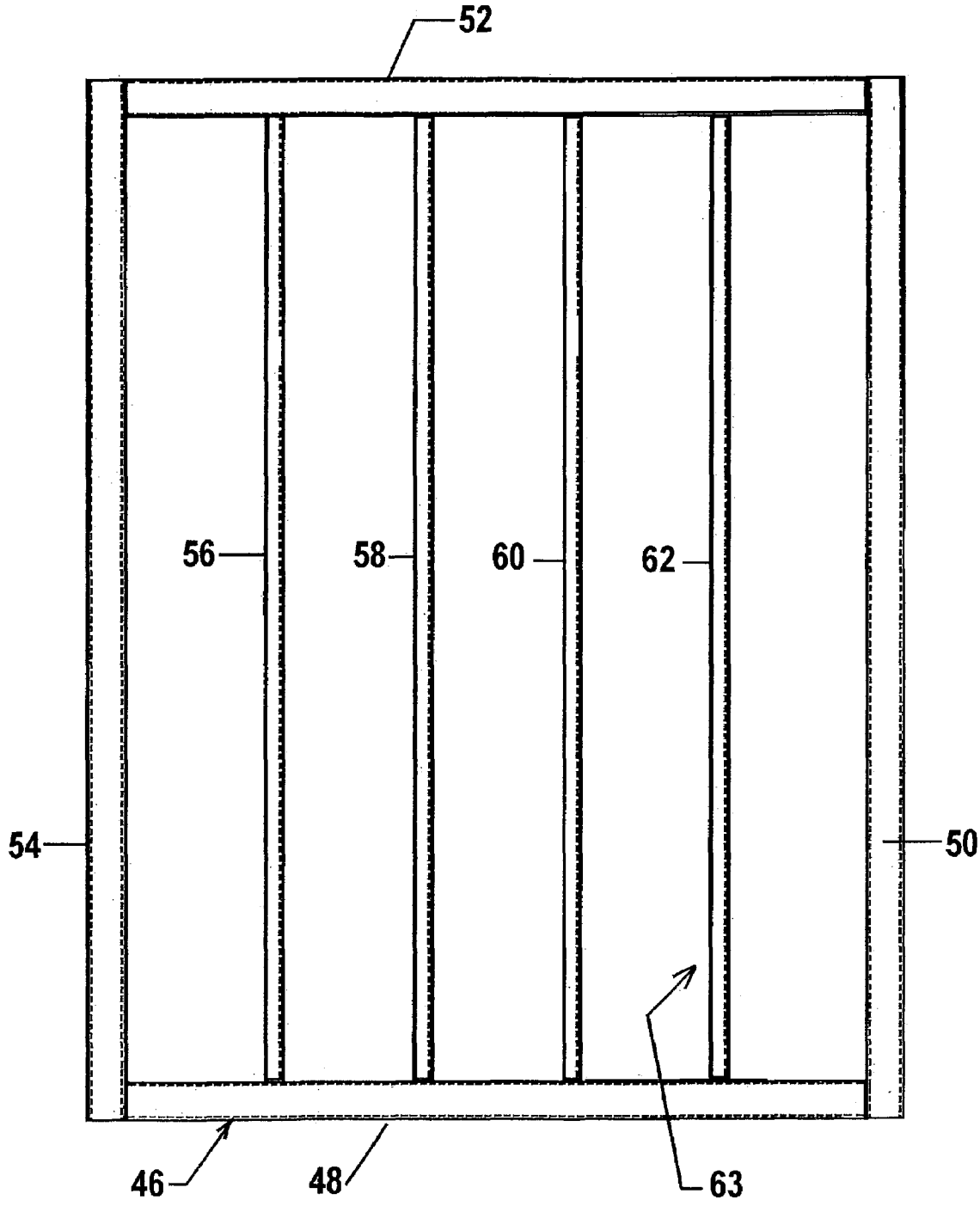
FIG. 5 is a plan view of the lower portion of the support frame for the mold assembly.
Figure 6:
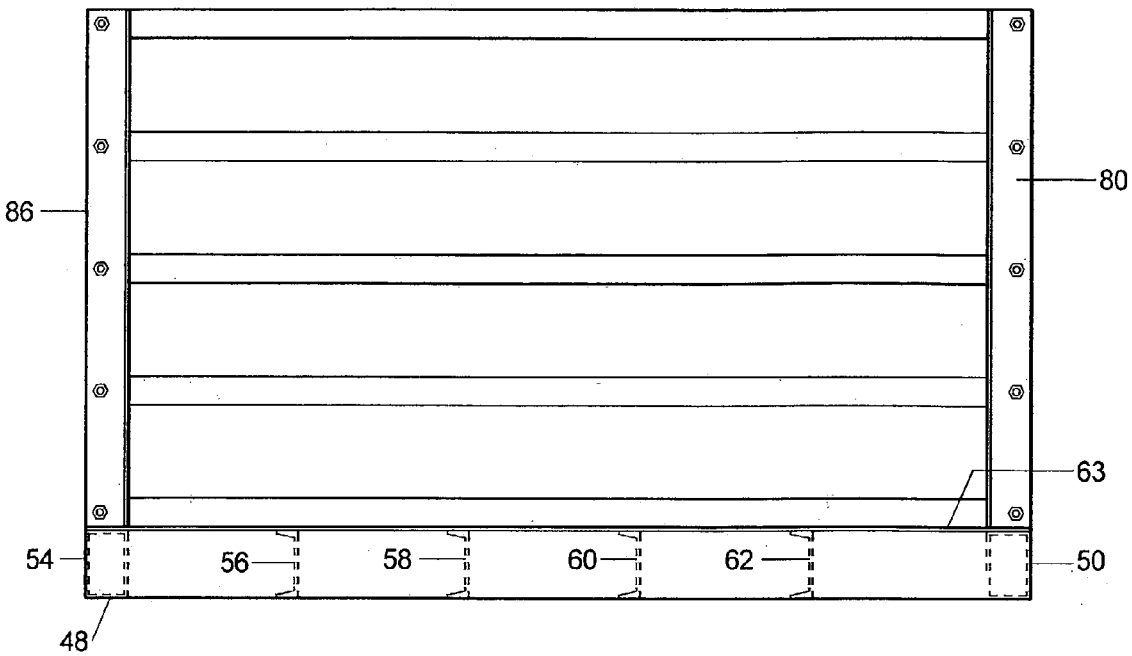
FIG. 6 is a side elevational view of the mold assembly.

As best shown in FIGS. 2–4, mold components 44 are juxtaposed in a generally parallel manner within frame 42. More particularly, the mold components are arranged generally vertically side-by-side within assembly 40. Each mold component extends upwardly from the floor 63. As will be described more fully below, this permits the wall panels 10 to be formed and removed in a vertical condition rather than horizontally as is conventionally performed. The individual mold components, which are described more fully below, are separated by channel pieces 130. A channel piece is disposed vertically between each end of a respective pair of mold components 44 proximate respective ends of frame 42. Each pair of adjoining mold components 44 is further separated by a spacer 130*a*, FIG. 9, carried above floor plate 63. Each adjoining pair of mold components 44, together with the channels 130 disposed between those adjoining mold components and the spacer 130*a* define a void or space 140, shown in FIGS. 2 and 3. Cement or other wall-forming material is introduced into this void and allowed to set to form a wall panel according to this invention.

Figure 7:
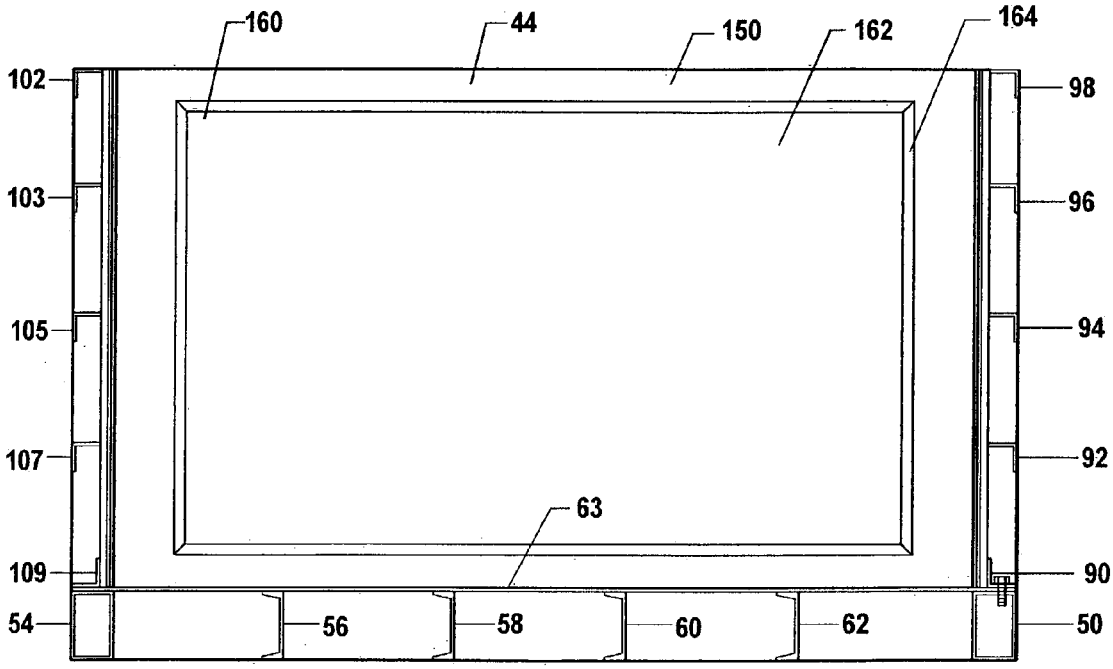
FIG. 7 is a cross sectional view of the mold assembly illustrating the frame and one of the mold components.
Figure 8:
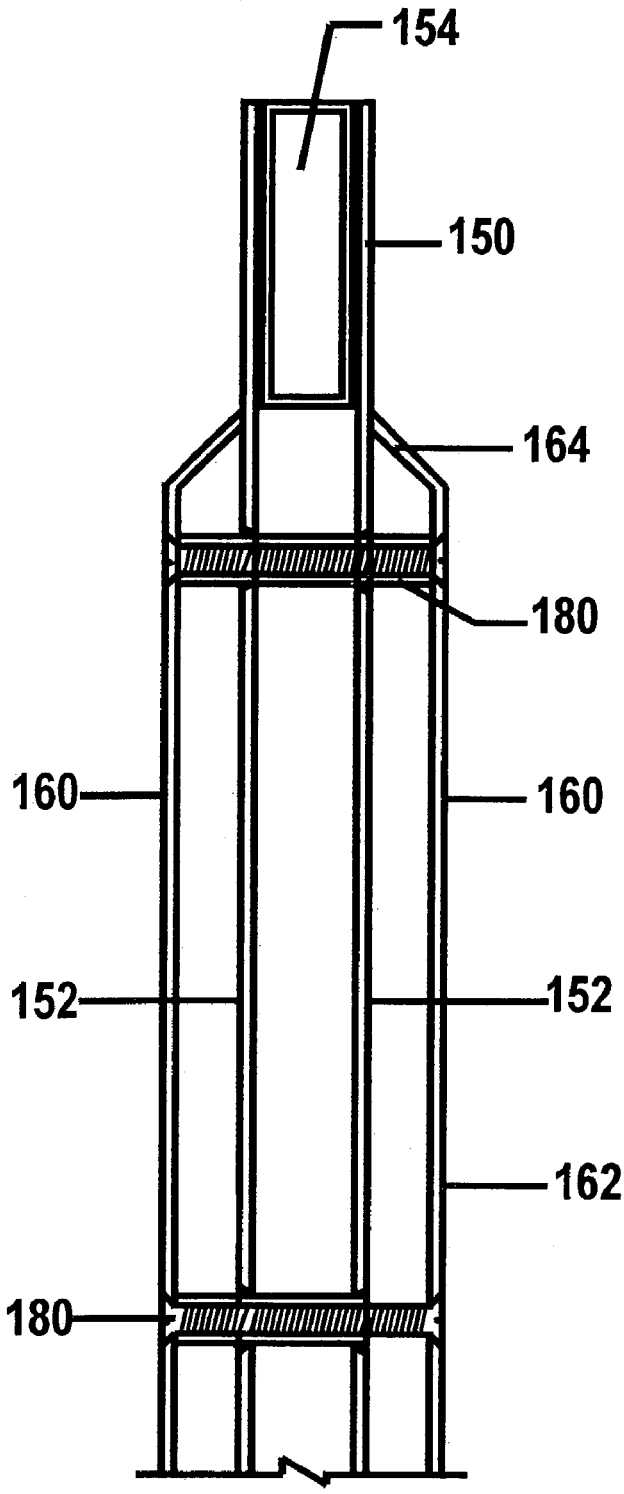
FIG. 8 is a partial cross sectional view of an upper end of one of the mold components, taken along line 8—8 of FIG. 3.
Figure 8A:
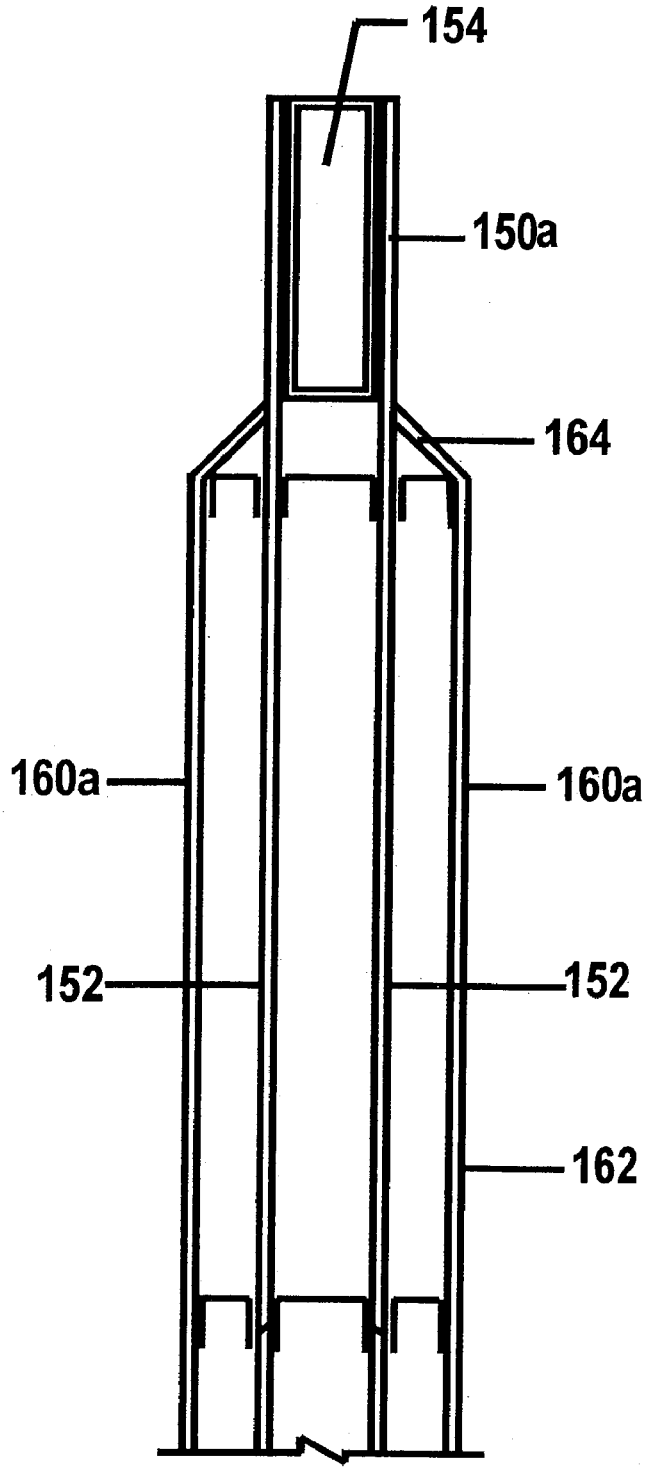
FIG. 8A is a partial cross sectional view of an alternative mold component employing permanent recess-defining components.
Figure 9:
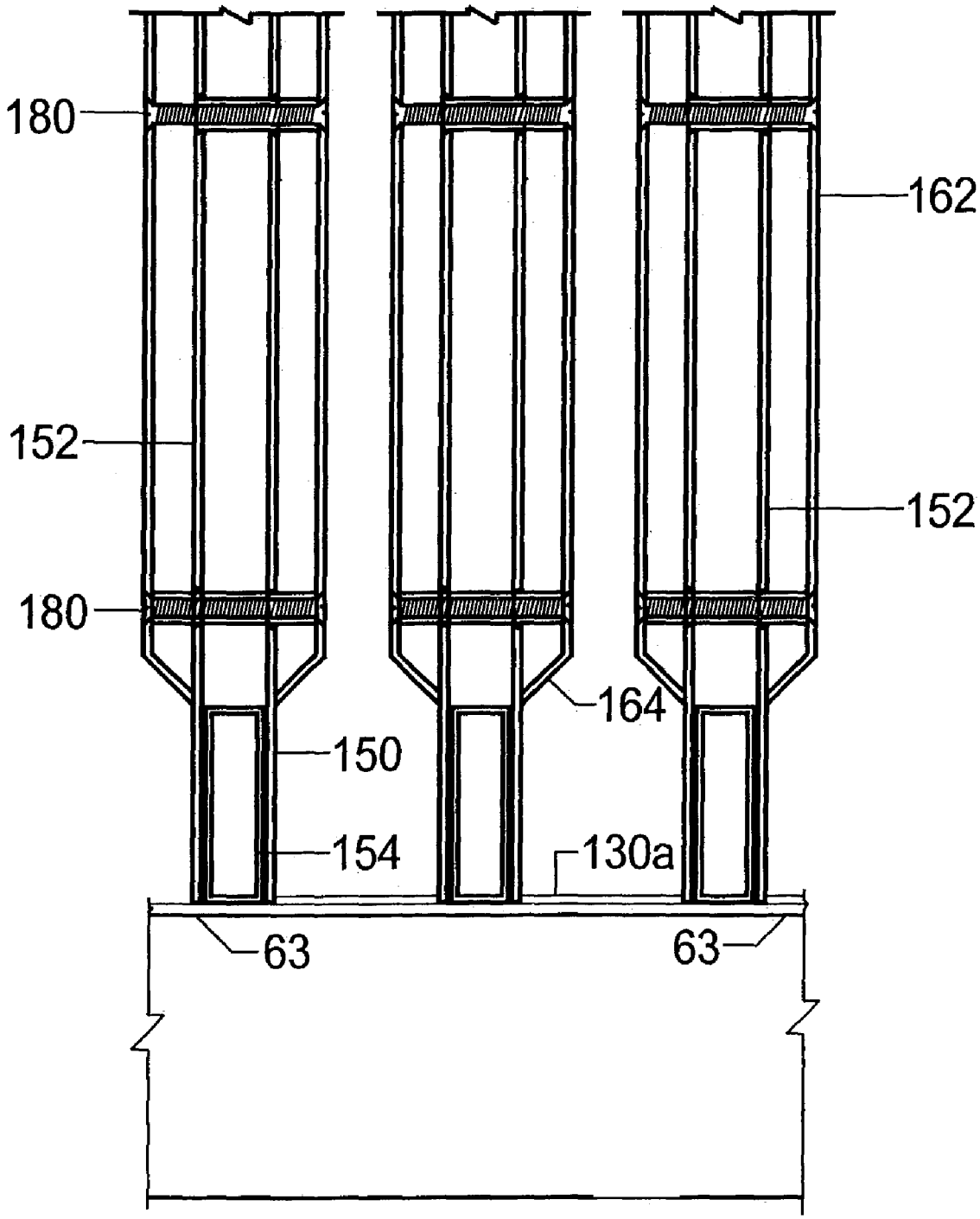
FIG. 9 is a partial cross sectional view of the lower ends of four adjacent mold components, taken along 9—9 of FIG. 3.
Figure 10:
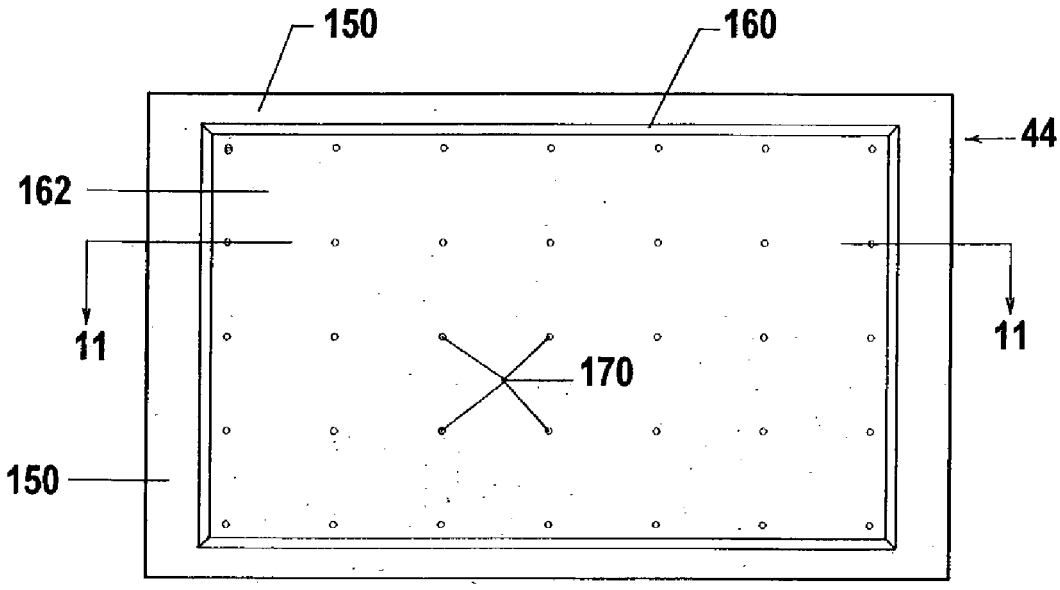
FIG. 10 is an elevational front view of one of the mold components.
Figure 11:
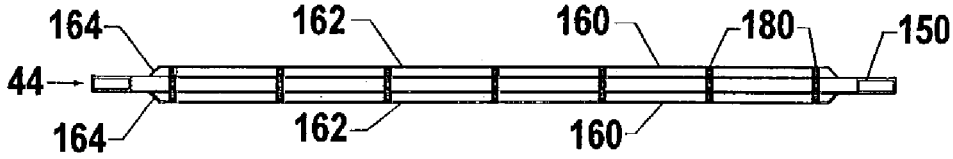
FIG. 11 is a cross sectional view of the mold component taken along 11—11 of FIG. 10.

The individual mold components 44 are shown in greater detail in FIGS. 7–11. As best illustrated in FIG. 7, mold component 44 generally has a rectangular shape that is the reverse or mirror image of panel 10. More particularly, as shown in FIGS. 7–9, each wall component comprises a central planar support piece 150. Piece 150 may actually comprise a pair of parallel plates 152 that are separated by a pair of 2"×6" spacers 154 located at the upper and lower ends of the adjoining mold components. A central, recess-defining component 160 is releasably interconnected to each broad face of planar support member 150. Each one of components 160 has a substantially flat outer surface 162 and a beveled or chamfered peripheral surface 164. As best shown in FIG. 10, a plurality of bolt receiving openings 170 are formed through flat surface 162 of component 160. The central support component 150 has a corresponding series of holes formed therein. Components 160 are arranged on respective sides of component 150 such that the holes in the recess-defining components align with respective holes in the central support component. The recess-defining components are then releasably secured to the central support component by appropriate means such as countersunk bolts 180 engaged with the aligned holes. The bolts are selectively disengaged from the aligned holes to remove the recess-defining components 160 so that those components may be interchanged to provide the completed wall panel with a desired texture or surface feature. It should be understood that the recess-defining components 160 and the central supporting component 150 may have alternative shapes, configurations and constructions. The central component may comprise a unitary piece of material. Steel and other suitable metals are preferably used for the mold component. Alternatively, various forms of plastic, fiberglass, wood, etc. may be employed. In other embodiments of this invention, the wall panel mold components may include flat sides without recess-defining components. Other versions, such as shown in FIG. 8A, may employ recess-defining components 160*a* that are permanently secured (welded) to central supporting member 150*a*.

Figure 12:
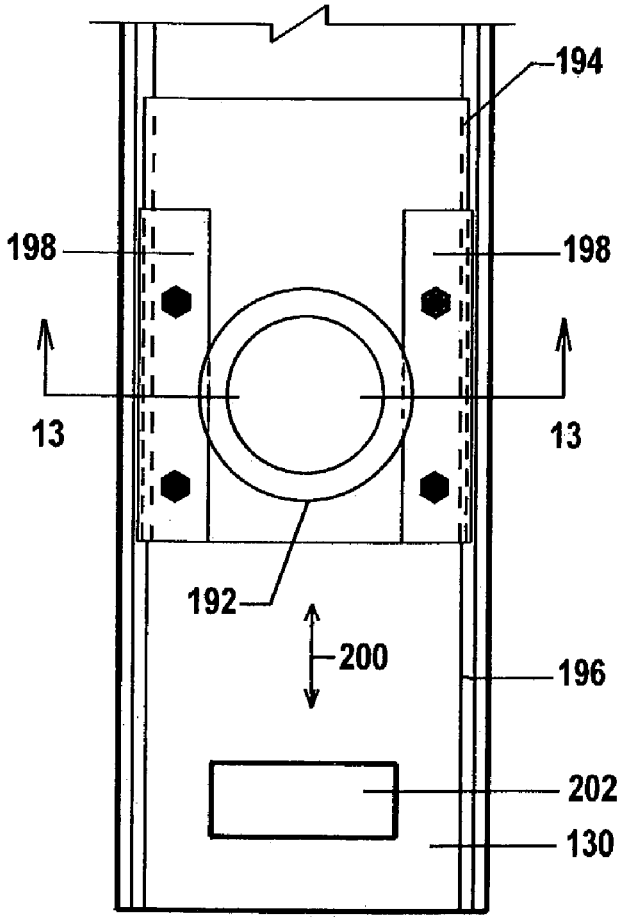
FIG. 12 is an elevational front view of the injection port used to introduce the wall panel forming material into the mold.
Figure 12A:
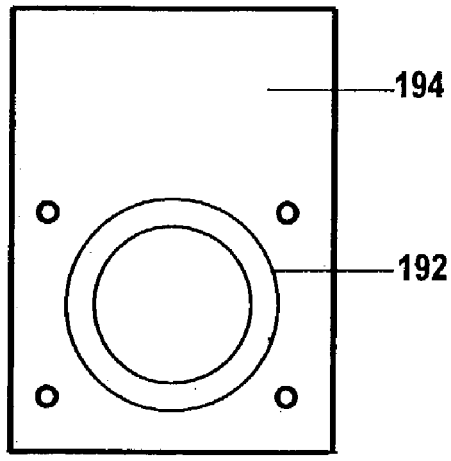
FIG. 12A is a plan view of the plate on which the injection port is mounted.
Figure 13:
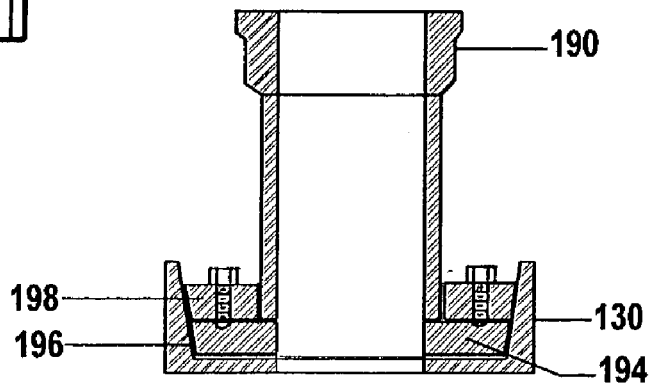
FIG. 13 is a plan view of the adjustable injection port.

Mold assembly 40 further includes an injection inlet for introducing concrete wall-forming material into the mold. A preferred inlet is depicted in FIGS. 12, 12A and 13. In particular, each channel 130 defining the side of the mold carries an adjustable injection port assembly 190. The injection inlet includes an injection fitting 192 that is mounted on a plate 194. The plate is slidably engaged with an appropriate slot 196 formed on the outside of channel 130. In this version, a pair of brackets 198 retain plate 194 within longitudinal slot 196. As a result, apparatus 190 is longitudinally slidable up and down within channel 130, as indicated by double headed arrow 200. An inlet hole 202 is formed through the center of channel 130. To introduce concrete into the mold, apparatus 190 is simply slid downwardly so that injection fitting 192 is aligned with hole 202. Concrete is then pumped through the fitting and aligned opening into the mold. After the void or space in the mold is filled with concrete, plate 194 is adjusted so that the injection fitting 192 is no longer aligned with hole 202. Instead, a flat part of the plate blocks the hole. It should be noted that the above described injection port is preferably formed proximate the lower end of the vertical mold. This permits concrete to be pumped into the mold space such that the space is filled from bottom to top. Air is pushed out through the upper end of the mold and air pockets are virtually, if not completely, eliminated. The panel thereby exhibits an improved structural integrity and reduces and resists cracking. Alternative injection fittings may be employed within the scope of this invention.

Figure 14:
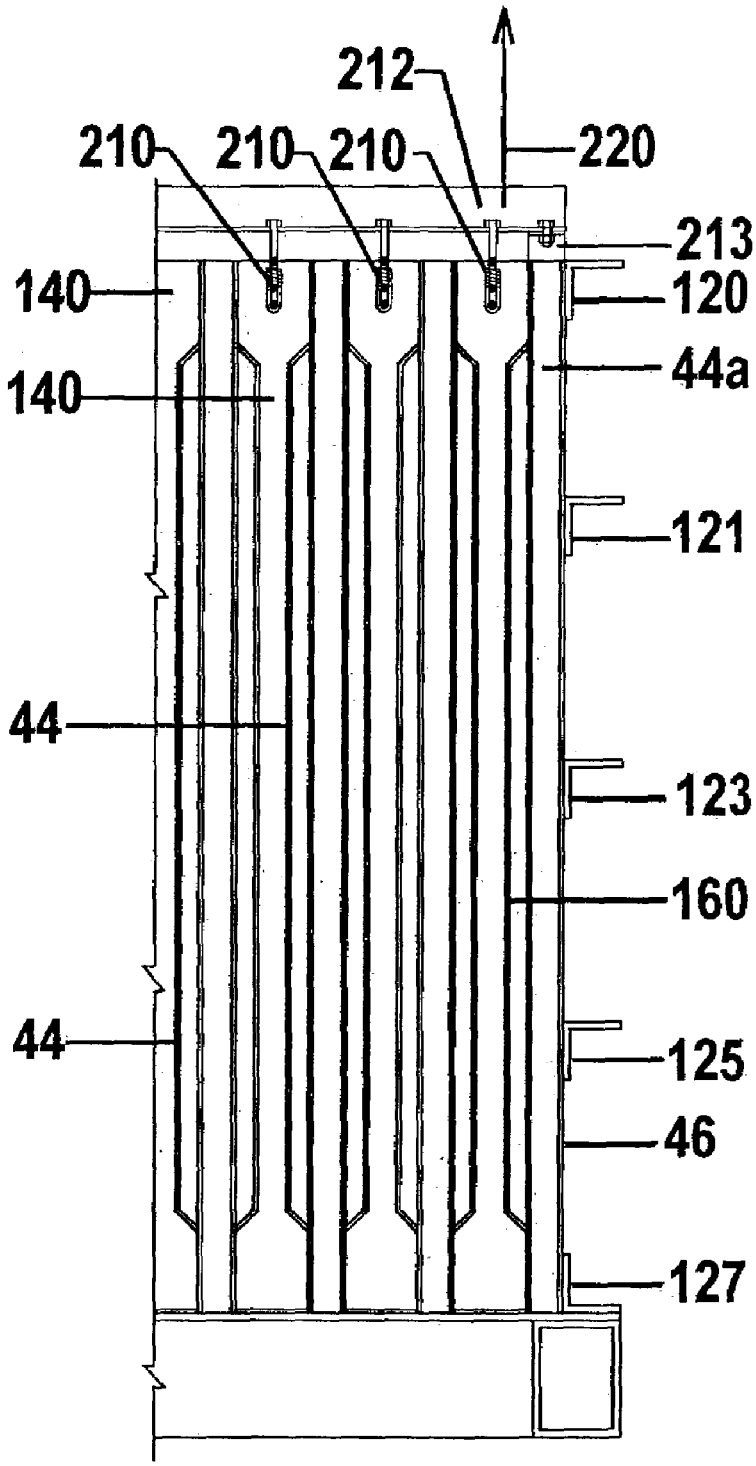
FIG. 14 is a cross sectional view of a portion of the mold assembly before concrete is introduced into the assembly and with panel lifting or removal inserts positioned within each of the voids of the mold.

As shown in FIG. 14 and further shown in FIG. 3, a slightly different mold component 44*a* is formed at each end of the juxtaposed series of mold components. Mold component 44*a* is constructed similarly to the previously described mold component. It includes a generally planar central support member 150. In contrast to the other mold components, however, the end mold components carry only a single recess-defining component 160, which faces interiorly into the mold assembly. The outwardly facing surface of member 150 flushly engages the beams 110–118 and 120–127 formed along the sides of the mold assembly. The outwardly facing surface of component 44*a* does not carry a recess-defining mold component. This is not needed because there is no void or space formed against the outwardly facing surface of the support member 150 located at a side of the mold assembly.

In FIG. 14, a plurality of threaded lifting inserts 210 are positioned within respective mold spaces 140. The lifting inserts are carried by an elongate bar 212 that is positioned across the upper end of the mold assembly and supported by an angle 213. Bar 212 carries depending shafts 214. Each shaft carries a threaded member 216 that is threadably engaged with a respective insert 210. After concrete is introduced into each mold space 140 and allowed to hardened, the threaded members 215 are disengaged from inserts 210. An appropriate I-hook device is then threadably engaged with each insert 210. The beams and angles of the mold assembly frame 42 are released by loosening bolts 100, FIG. 2. This releases the mold components 44 from the frame. The mold components are easily separated and the molded wall panels are lifted vertically from the mold by means of the attached I-hooks. In effect, the panels are lifted in the direction of arrows 220 in FIG. 14.

As previously described, an elongate rebar element extends through each thick segment formed along a respective peripheral edge the completed panel. These may be installed in the molds and cast into the completed panels using various techniques. First the rebar is installed in the mold cavity. Concrete is then introduced and the rebar is cast in the wall panel as the panel sets. Each previously described thick peripheral segment of the wall panel includes an elongate segment of rebar that extends longitudinally through that thick segment.

In preferred embodiments, the rebar includes projecting sections that depend below the lower edge of the wall after it is formed. The rebar is positioned by a hole through bottom spacer 130*a* and a slot through base plate 63 (see FIG. 9). Various other ways may be used to extend the reinforcing bar from the wall panels. For example, a threaded dowel bar may be attached to a lower end of the cast rebar by a dowel splicer. See below.

The mold assembly permits multiple panels to be constructed conveniently and efficiently. The molding process is done in the aforedescribed manner such that the panels are formed vertically within the vertically oriented mold components. This utilizes factory space much more efficiently than conventional horizontal molding assemblies. In effect, each mold space uses the vertical space of the factory rather than the horizontal floor space. Manufacturing a comparable number of panels using horizontal molds would require considerably greater floor space. Moreover, a desired number of panels are produced much faster using assembly 40 than are produced using a conventional horizontal mold. The completed panels are not only modular, they feature identical configurations and finishes on both opposing faces of each panel. In alternative embodiments, the opposing faces may be configured or finished differently.

After a series of wall panels are molded in the above described manner, the panels are lifted vertically. As a result, the manufacturer is able to take advantage of the vertical thickness, strength and integrity of the finished panel. The panel does not crack or deteriorate as it is lifted from the mold. This contrasts with conventional molds wherein great stress is placed upon the finished panel as it is lifted horizontally out of the mold.

Figure 16:
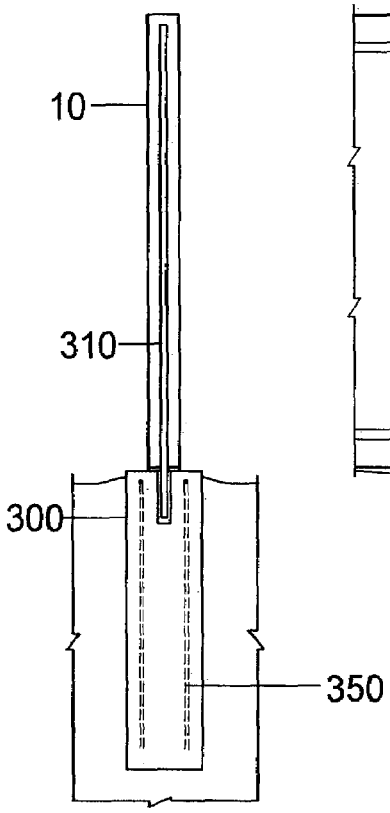
FIG. 16 is a cross sectional view taken along line 16—16 of FIG. 15.
Figure 15:
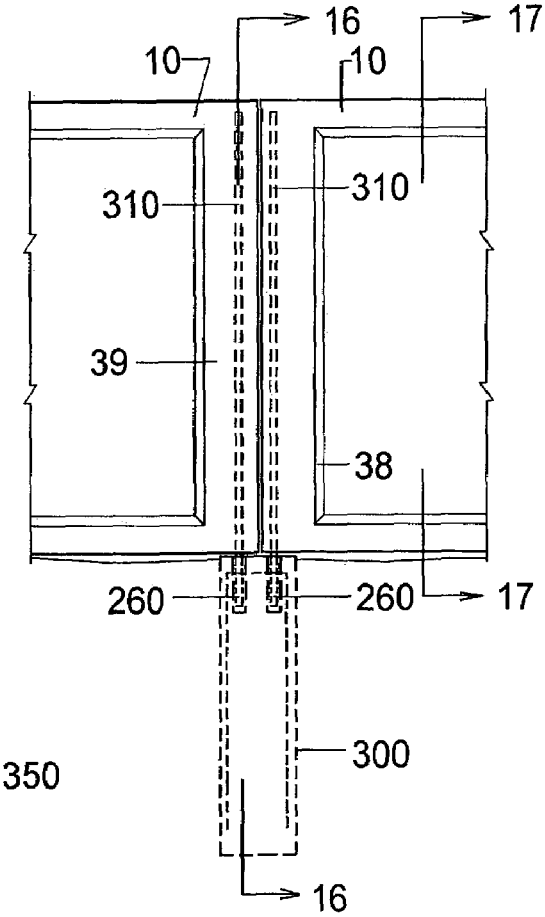
FIG. 15 is an elevational view of a pair of adjoining wall panels illustrating how the panels are mounted to a cylindrical footing.
Figure 17:
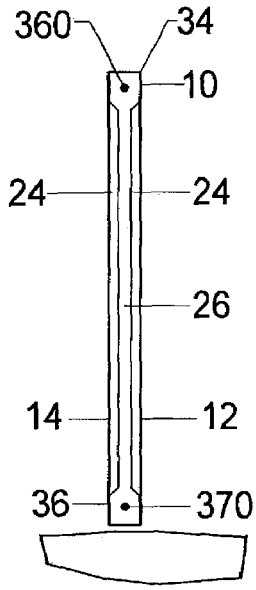
FIG. 17 is a cross sectional view taken along line 17—17 of FIG. 15.

FIGS. 15–17 depict the wall panels after they are installed for use. As shown in FIG. 15, a representative pair of adjoining wall panels 10 are supported at their abutting ends on a cylindrical footing 300. The ground is first prepared and a cylindrical footing is installed. Each panel 10 carries a vertical reinforcing bar 310 that extends vertically through a thick side segment of the panel. In one of the panels, bar 310 extends through thick side segment 38 and in the other panel, bar 310 extends vertically through side segment 39. Depending bar segment 260 is introduced into a corresponding hole drilled into cylindrical footing 300. An appropriate glue, adhesive or epoxy is inserted into the hole so that the reinforcing bar remains securely in place within the footing. Segment 260 may be an extension of 310 or may be a dowel that is attached to the panel by screwing into a threaded insert. FIG. 16 illustrates the interconnection between reinforcing bar 310 and footing 300. Each cylindrical footing includes its own reinforcing bar 350. Each footing can support the ends of two adjacent panels or each dowel may be engaged with a respective footing. The foregoing construction eliminates the use of vertical support posts interposed between adjoining panels 10. The panels are self supporting. This saves considerable manpower, time, expense and material normally required to install such posts.

FIG. 17 illustrates one of the wall panels 10 as viewed cross sectionally through the relatively thin portion 26 of the wall panel. The opposing recess portions in faces 12 and 14 are clearly illustrated. Additionally, the horizontal sections of reinforcing bar 360 and 370 extending through upper and lower thick panel segments 34 and 36, respectively are shown.

FIG. 18 illustrates a completed wall system that employs a number of the panels 10 formed and installed in the foregoing manner. A space is left between two of the panels so that a door or gate 400 may be installed. The completed wall system is extremely durable and yet lightweight and efficient. It is able to withstand wind speeds of up to 140 mph. The wall is manufactured in quick, convenient and relatively inexpensive manner. Installation does not require numerous different types of skilled tradesmen.

The corresponding recesses and finishes formed on the opposing faces of each panel 10 are particularly advantageous. Significant material and expense are saved without sacrificing strength. Additionally, because the faces are symmetrical, the panels can be quickly and efficiently installed with minimal manipulation. A consistent, aesthetically attractive appearance is exhibited by both sides of the wall.

The method of manufacturing the wall panels in vertical molds is a particularly unique and advantageous feature of this invention. Much less stress is placed on the completed panels and considerable manufacturing space is conserved. A far greater number of panels can be produced on a daily basis than are possible using conventional horizontal molds. In contrast to the prior art, the wall system does not require the use of continuous footings, special reinforcing and foundations that must be excavated well below the surface of the ground. A series of relatively simple, efficient and inexpensive cylindrical footings may be used to support the wall panels. Because panels are supported independently of one another, the panel layout is flexible, allowing variety in design. Selected spacing and configurations may be employed.

It should be understood that various other types of beams, angles, plates and structural components may be employed in the frame and mold components. The wall forming material may comprise various hardenable substances other than concrete (i.e. plastics).

From the foregoing it may be seen that the apparatus of this invention provides for a self supporting, pre-cast concrete wall system. While this detailed description as set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A vertical mold apparatus for manufacturing a plurality of pre-cast wall panels, said apparatus comprising:

an exterior frame;

a series of wall face-defining mold components juxtaposed side-by-side and arranged generally vertically within said frame to extend upwardly from a floor of said frame, said mold components comprising a pair of end mold components located at respective ends of said series, each said end mold component having a generally planar support portion and a recess-defining component attached to an inwardly facing side thereof, and further including at least one intermediate mold component disposed between said end mold components, each intermediate mold component including a generally planar support portion and a pair of recess-defining components attached respectively to opposite sides of said support portion, each adjoining pair of mold components having opposing recess-defining components that generally face one another, each recess-defining portion being carried centrally on a respective face of an associated support portion such that said support portion includes a horizontally exposed border that completely peripherally surrounds said attached recess-defining portion; and each adjacent pair of mold components being spaced apart from one another along respective vertical sides thereof, said frame holding said mold components together in a juxtaposed condition such that a plurality of generally parallel, vertically oriented voids are formed, whereby casting material is introduced into said voids and allowed to set to form a plurality of wall panels.

2. The apparatus of claim 1 in which said peripheral border of said support includes upper and lower horizontal border segments formed respectively above and below said recess-defining portion and a pair of vertical border segments interconnecting respective ends of said horizontal segments on respective sides of said recess-defining portion, whereby said void includes a relatively thin central section between said facing recess-defining portions and a relatively thick border section peripherally surrounding said relatively thin central section.

3. The apparatus of claim 2 in which said horizontal border segments are parallel to one another and said vertical border segments are parallel to one another such that said exposed border of said support portion forms a rectangular configuration surrounding said recess-defining portion and said relatively thin border section of said void includes a corresponding parallel pair of horizontal compartments and a corresponding parallel pair of vertical compartments, each compartment for receiving a respective reinforcing element to strengthen concrete poured into said void region.

4. The apparatus of claim 1 in which said recess-defining portion includes a flat surface and a chamfered edge peripherally surrounding said flat surface and interconnecting said flat surface to said support portion.

5. The apparatus of claim 2 in which said border has a rectangular configuration surrounding said recess-defining portion and said border section of said void includes a correspondingly shaped rectangular configuration surrounding said central section of said void.

6. The apparatus of claim 1 further including an injection port formed into said void proximate a lower end thereof, said casting material being introduced through said port and pushed upwardly through said void so that air pockets within said void are eliminated.

* * * * *